United States Patent [19]

Obenshain

[11] Patent Number: 4,951,904

[45] Date of Patent: Aug. 28, 1990

[54] STAKE SUPPORTED MAILBOX POST

[75] Inventor: James R. Obenshain, Peebles, Ohio

[73] Assignee: The Cedar Works, Inc., Peebles, Ohio

[21] Appl. No.: 459,434

[22] Filed: Jan. 2, 1990

[51] Int. Cl.[5] ..... A47G 29/12

[52] U.S. Cl. ..... 248/156; 52/165; 232/39

[58] Field of Search ..... 248/545, 530, 532, 533, 248/121, 156; 52/165; 232/38, 39

[56] References Cited

U.S. PATENT DOCUMENTS

| | | | |
|---|---|---|---|
| 427,815 | 5/1890 | Wolf | 52/165 |
| 442,290 | 12/1890 | Leever | 52/165 |
| 1,038,147 | 9/1912 | Johnson | 52/165 |
| 1,281,062 | 10/1918 | Norvell | 232/39 |
| 2,538,118 | 1/1951 | Miller . | |
| 2,738,941 | 3/1956 | Laurich et al. . | |
| 4,156,332 | 5/1979 | Thompson . | |
| 4,213,560 | 7/1980 | Hall | 248/156 |
| 4,235,034 | 11/1980 | Black | 248/545 |
| 4,249,715 | 2/1981 | Repp . | |
| 4,279,104 | 7/1981 | Classen | 52/165 |
| 4,307,540 | 12/1981 | Reisner | 248/156 |
| 4,326,352 | 4/1982 | Barth | 248/545 |
| 4,395,012 | 7/1983 | Rance . | |
| 4,483,506 | 11/1984 | Litwiller . | |
| 4,644,713 | 2/1987 | Lehman | 52/165 |
| 4,765,277 | 8/1988 | Bailey et al. . | |
| 4,825,575 | 5/1989 | Rethke | 248/533 |

*Primary Examiner*—Ramon O. Ramirez
*Assistant Examiner*—Robert A. Olson
*Attorney, Agent, or Firm*—Barnes & Thornburg

[57] ABSTRACT

A post assembly for use with mailboxes and the like includes a ground-engaging stake of angle-iron, the stake having a lower penetrating portion and an upper protruding portion. A post has a lower end including a diagonal surface and a channel entirely along one side including a slot along one edge of the channel for receiving the upper protrucing portion of the ground-engaging stake. Fasteners penetrating the ground-engaging stake upper protruding portion engage the channel portion of the post. A coverstrip covers the channel, upper protruding portion of the stake, and fasteners so as to permit the assembly to appear as a solid post.

10 Claims, 1 Drawing Sheet

STAKE SUPPORTED MAILBOX POST

BACKGROUND OF THE INVENTION

The present invention pertains generally to the art of support posts and standards, particularly, posts for use to support mailboxes, signs, and the like. The invention relates particularly to posts which are specifically designed to be installed without requiring the digging of a hole in the ground.

Posts for supporting mailboxes adjacent to a road or highway so as to permit vehicular delivery of mail are common, particularly in rural areas. The posts used to support the mailboxes are generally erected by first digging a hole, inserting the post into the hole, and later filling concrete or dirt around the post so as to secure the position of the post in the hole. The portion of the post extending down into the hole may amount to two or three feet so as to provide adequate support for the post. In the event of frost heave or accidental impact with the post considerable effort is required to reset the post to its proper position.

In more recent years, several designs for "no-dig" posts have been developed which include a ground-engaging stake which is designed to be hammered or driven into the ground. This driven stake provides a foundation member to which a post can then be secured by means of clamps, bolts, screws, or similar fastening means. Such structures enjoy the advantage of ease of installation and enhanced stability inasmuch as the ground around the ground-engaging stake is largely undisturbed by the installation process. While such posts have enjoyed increasing popularity, there remains a substantial desire on the part of homeowners to retain a "natural" appearance for the post and to avoid the appearance of any bolts, screws, or other securing means engaging the lower portion of the post to the ground-engaging stake or anchor.

SUMMARY OF THE INVENTION

A post assembly in accordance with the present invention includes a ground-engaging stake preferably made of angle-iron, the stake having a lower penetrating portion and an upper protruding portion. A wood post has a lower end including a diagonal surface and a channel entirely along the longer side of the post. A slot is included along one edge of the channel which together with the channel receives the upper protruding portion of the ground-engaging stake. The diagonal surface of the lower end of the post contributes to the initial positioning of the wood post adjacent to the ground-engaging stake where upon fastening means such as screws can be inserted to penetrate the ground-engaging stake upper portion locking it into the slot and channel in the wood post. A cover strip is then inserted into the channel to cover the channel, upper protruding portion of the stake, and fasteners so as to permit the assembly as a whole to appear as a solid post.

A cross arm of a convenient design can be connected to an upper end of the post to project laterally for supporting a mailbox or the like. A vertical extension in the nature of a cap or capital can be fixed to the upper mounting surface of the cross arm in line with the post so as to present a more pleasing appearance for the assembly.

One feature of the present invention is the use of an easily installed ground-engaging stake which subsequent to installation is not visible. This has the advantage of providing a very easily installed structure having an improved appearance over other no-dig posts.

Another feature of the present invention is the presence of the slot and channel in the post which preferably extends along the entire length of the post. This has the advantage of permitting the post to be assembled to the ground-engaging stake regardless of the length of the protruding portion.

Other features and advantages of the present invention will become apparent to those skilled in the art upon consideration of the following description of a preferred embodiment exemplifying the best mode of carrying out the invention as presently perceived. The detailed description particularly refers to the accompanying drawings.

DESCRIPTION OF THE PREFERRED EMBODIMENT

Figures 1, 2, 3, 4:
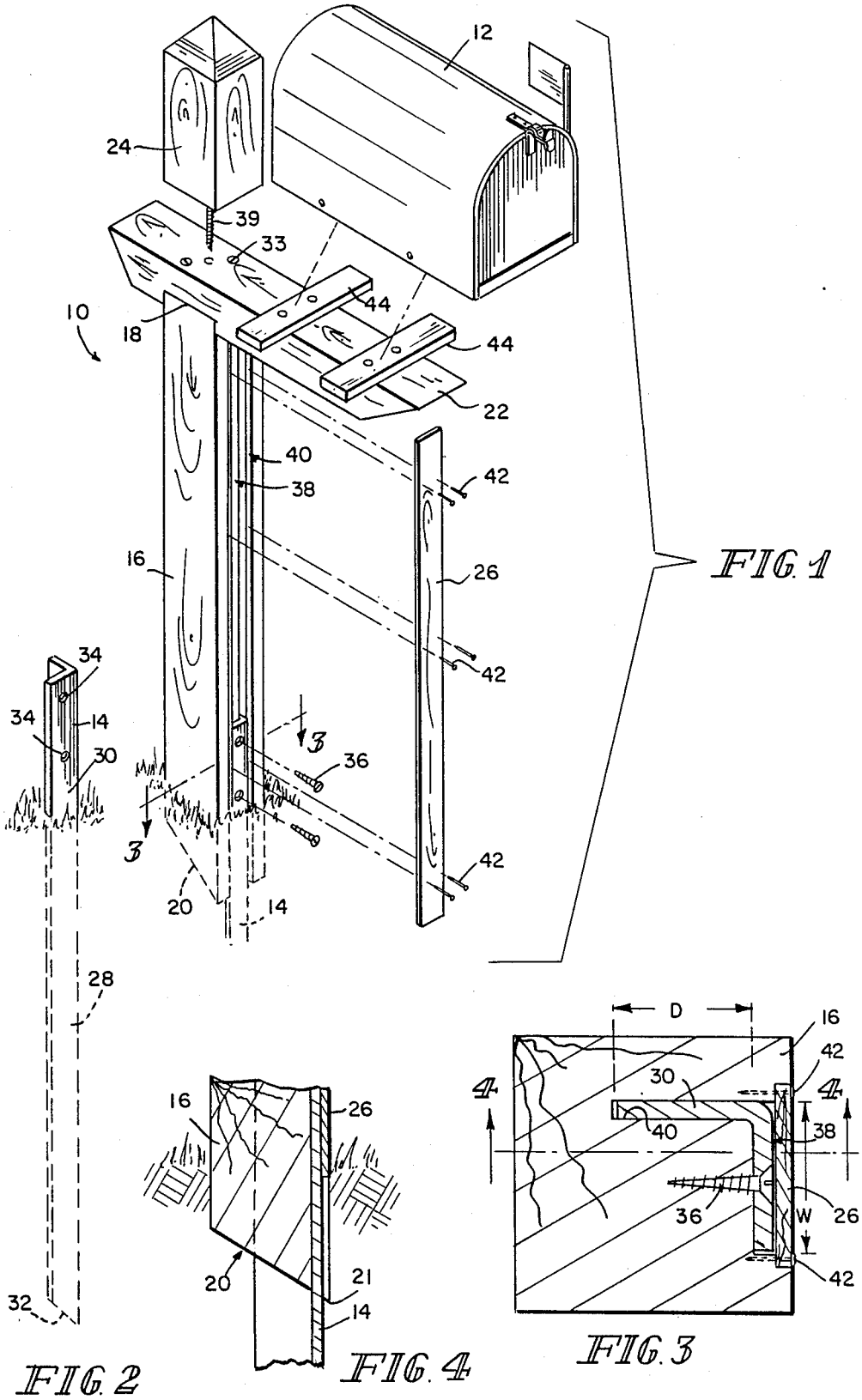
FIG. 1 is an exploded view of a post assembly in accordance with the present invention illustrating its utility with a mailbox.
FIG. 2 is a perspective view of a ground-engaging stake used in a post assembly as shown in FIG. 1.
FIG. 3 is a sectional view of the post assembly taken along lines 3—3 of FIG. 1.
FIG. 4 is a sectional view taken along lines 4—4 of the FIG. 3.

A post assembly 10 is shown in FIG. 1 adapted for use with a mailbox 12. It will be appreciated by those skilled in the art that a post assembly in accordance with the present invention may have utility other than to support a mailbox. The post assembly 10 generally includes a ground-engaging stake 14 which is more fully illustrated in FIG. 2. The post assembly also includes a main vertical post 16 preferably made of wood having an upper end 18 and a lower end 20, the lower end being defined by a diagonal surface having a lowermost edge 21 as shown in FIG. 4. The post assembly also includes securing means 36 for securing the post 16 to the ground-engaging stake 14. A cross arm 22 is provided for supporting the mailbox 12 or other article, a vertical extension 24 can be included for extending the vertical line of post 16. A cover strip 26 is provided to permit the assembly as a whole to appear as a solid post.

The ground-engaging stake 14 is shown in FIG. 2 to comprise a lower, ground-penetrating portion 28 and an upper protruding portion 30. The lower end 32 of the ground-engaging portion 28 is preferably shaped so as to permit the stake 14 to be easily driven into the ground with a hammer or a similar tool. The protruding portion 30 includes a pair of holes or apertures 34 for receiving fastener means 36 shown in FIG. 1. The ground-engaging stake 14 can be made from a length of angle-iron. The size of the angle-iron forming at least the upper portion of the ground-engaging stake 14 is selected such that it will penetrate about half-way through the wood post 16 as shown in FIG. 4.

The upright post 16, preferably constructed of wood so as to retain a "natural" look includes a channel 38. The width W of the channel is slightly greater than the width of one of the sides of the protruding portion of the ground-engaging stake 14 so as to permit the ground-engaging stake to be received in the channel 38. A slot 40 is provided along one edge of channel 38, the depth D of the slot being approximately equal to the width of another of the legs of the ground-engaging stake and of appropriate width to receive the ground-engaging stake as shown in FIG. 3.

The inclined lower surface 20 of the post 16 with its lower most edge 21 simplifies the aggregation of the post assembly and ensures a secure positioning of the post 16 relative to the ground-engaging stake 14 prior to insertion of the fastening means 36. This aggregation is achieved by first driving the ground-engaging stake 14 into the ground. The wood post 16 is then situated with the lowermost edge 21 adjacent to the stake 14 and tapped lightly until all of the lower end 20 is below the upper surface of the ground. With the post 16 and ground-engaging stake 14 firmly situated together, the fastening means 36 in the form of wood screws couple the stake 14 to the post 16.

Similar fastening means 33 can be employed to couple the cross arm 22 to the upper end 18 of post 16. Similar means 39 can also be employed to couple the cap or capital 24 to the cross arm 22, as shown in FIG. 1. It will be appreciated that the cap or capital 24 is an optional structure not serving any structural purpose but merely contributing to the overall esthetics of the assembly.

To ensure that the assembly as a whole appears as a solid post, a cover strip 26 having a width approximately equal to the width of channel 38 and the length sufficient to extend from the lower surface of the cross arm 22 to the ground is secured in the channel 38 as shown in FIG. 3. Small nails or brads 42 can be employed conveniently to secure the strip 26 in the slot 40. Preferably the nails 42 are dimensioned such that from any appreciable distance, they become substantially invisible against the background of the wood post 16 and strip 26 as a whole, thereby achieving the overall objective of having the assembly appear as a solid post.

The cross arm 22 can be of any convenient dimension and the cross arm shown in FIG. 1 is merely illustrative of one possible dimension. The cross arm 22 generally projects laterally sufficiently far to provide a surface for mounting the mailbox support strips 44 or other hardware of equivalent function to receive and support mailbox 12 or another article desired to be supported by the post assembly.

Although the invention has been described in detail with reference to the illustrated preferred embodiment, variations and modifications exist within the scope and spirit of the invention as described and as defined in the following claims.

What is claimed is:

1. A post assembly for use with mailboxes and the like comprising:

a ground-engaging stake comprising a pair of elongated planar strips joined together along a common edge at a right angle, the stake having a lower penetrating portion and an upper protruding portion;

a post including along one side a channel having a depth slightly greater than the thickness of one of the strips and a width slightly greater than the width of one of the strips, and including a slot along one edge of the channel having a depth of about the width of one of the strips and a width of about the thickness of one of the strips, the channel and slot extending from a lower end of the post at least the length of the stake upper protruding portion providing engagement between the post and stake; and a coverstrip having a length and width of about the length and width of the channel, and a thickness of about the depth of the channel covering the channel and upper protruding portion of the stake so as to appear as a solid post.

2. The post assembly of claim 1 wherein each of the planar strips extends continuously from an upper end of the upper protruding portion to a lower end of the lower penetrating portion.

3. The post assembly of claim 1 wherein the channel extends along the entire length of the post.

4. The post assembly of claim 1 wherein the lower end of the post comprises a diagonal surface having a lower most edge common with a lower most edge of the one side of the post including the channel.

5. A post assembly for use with mailboxes and the like comprising:

a ground-engaging stake comprising a lower penetrating portion and an upper protruding portion, the upper protruding portion comprising first and second elongated planar strips joined together at an angle;

a post including along one side a channel having a depth greater than the thickness of the first of the strips and a width greater than the width of the first of the strips, and including a slot in the channel having a depth of about the width of the second of the strips and a width of about the thickness of the second of the strips, the channel and slot extending from a lower end of the post at least the length of the stake upper protruding portion to permit engagement between the post and stake; and a coverstrip having a length and width of about the length and width of the channel, and a thickness of about the depth of the channel for covering the channel and upper protruding portion of the stake so as to permit the assembly to appear as a solid post.

6. The post assembly of claim 5 wherein the lower end of the post comprises a diagonal surface having a lower most edge common with a lower most edge of said one side of the post for urging the post into engagement with the ground-engaging stake.

7. The post assembly of claim 6 further comprising means penetrating the ground-engaging stake upper protruding portion and extending into said one side for securing the post to the ground-engaging stake.

8. The post assembly of claim 7 further comprising a cross arm for connection to an upper end of the post to project laterally to overlie said one side, the cross arm having an upper mounting surface.

9. The post assembly of claim 8 further comprising a capital for fixing to the upper mounting surface of the cross arm in line with the post.

10. A post assembly for use with mailboxes and the like comprising:

a ground-engaging stake comprising a pair of elongated planar strips joined together along a common edge at a right angle, the stake having a lower penetrating portion and an upper protruding portion;

a post having an upper end and a lower end, the lower end comprising a diagonal surface having a lower most edge, the post including entirely along one side having an edge common with the lower most edge of the lower end diagonal surface a channel having a depth slightly greater than the thickness of one of the planar strips and a width slightly greater than the width of one of the planar strips, and including a slot along one edge of the channel having a depth of about the width of one of the planar strips and a width of about the thickness of one of the planar strips, the slot extending from a lower end of the post at least the length of the stake upper protruding portion providing engagement between the post and stake;

securing means penetrating the ground-engaging stake upper protruding portion and engaging said one side for securing the post to the ground-engaging stake;

a cross arm connected to the upper end of the post and projecting laterally to overlie said one side, the cross arm having an upper mounting surface; and a coverstrip having a length and width of about the length and width of the channel, and a thickness of about the depth of the channel, extending downward from the cross arm to cover the channel, upper protruding portion of the stake, and securing means so as to permit the assembly to appear as a solid post.

* * * * *